US011547188B2

(12) United States Patent
Myers

(10) Patent No.: US 11,547,188 B2
(45) Date of Patent: Jan. 10, 2023

(54) CUSTOMIZABLE CARD WALLET

(71) Applicant: Justin J. Myers, Plainfield, IL (US)

(72) Inventor: Justin J. Myers, Plainfield, IL (US)

( * ) Notice: Subject to any disclaimer, the term of this patent is extended or adjusted under 35 U.S.C. 154(b) by 385 days.

(21) Appl. No.: 16/819,086

(22) Filed: Mar. 14, 2020

(65) Prior Publication Data

US 2020/0305564 A1 Oct. 1, 2020

Related U.S. Application Data

(60) Provisional application No. 62/824,878, filed on Mar. 27, 2019.

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01)

(58) Field of Classification Search
CPC ..... A45C 11/182
See application file for complete search history.

(56) References Cited

U.S. PATENT DOCUMENTS 4,316,539 A * 2/1982 Torrington ..... G11B 23/0328 206/307
5,125,505 A * 6/1992 Kurosaki ..... G09F 3/18 206/556
5,740,624 A * 4/1998 Baseley ..... A45C 11/182 40/27.5
5,988,374 A * 11/1999 Funawatari ..... G11B 33/0416 206/308.1
9,661,908 B2 * 5/2017 Mayer ..... A45C 1/06
9,980,546 B2 * 5/2018 Van Der Laan ..... A45C 13/02
2003/0057112 A1 * 3/2003 Keough ..... A45C 11/182 206/39.4
2013/0180879 A1 * 7/2013 O'Dowd ..... G06F 1/1628 206/521
2013/0276943 A1 * 10/2013 Minn ..... A45C 1/06 150/137
2014/0060712 A1 * 3/2014 Beckley ..... A45C 1/06 150/133
2016/0045006 A1 * 2/2016 Moon ..... A45C 11/182 150/149
2018/0140061 A1 * 5/2018 Chan ..... A45C 1/06
2018/0140066 A1 * 5/2018 Talarico ..... A45C 11/182
2019/0269213 A1 * 9/2019 Deng ..... A45F 5/02

FOREIGN PATENT DOCUMENTS

KR 1851472 B1 * 6/2018 ..... A45C 11/00

* cited by examiner

*Primary Examiner* — John K Fristoe, Jr.
*Assistant Examiner* — Justin Caudill
(74) *Attorney, Agent, or Firm* — Cook Alex Ltd.

(57) ABSTRACT

A customizable card wallet accommodates a plurality of credit and identification cards. The wallet comprises a substantially rectangular top plate having a window opening in the central portion thereof, a substantially rectangular bottom plate having a pair of oppositely disposed relief channels at the periphery thereof for receiving a pair of oppositely disposed internal springs, and a substantially U-shaped card body interposed between the top and bottom plates, thereby defining an interior pocket. Upon insertion of at least one credit or identification card within the interior pocket, the internal springs urge the at least one card against the top plate interior facing surface.

14 Claims, 10 Drawing Sheets

CUSTOMIZABLE CARD WALLET

CROSS-REFERENCE TO RELATED APPLICATIONS

This application is related to and claims priority benefits from U.S. Provisional Patent Application Ser. No. 62/824,878 filed Mar. 27, 2019 entitled "Customizable Card Wallet". The '878 application is hereby incorporated by reference herein in its entirety.

FIELD OF THE INVENTION

The present invention relates to a wallet, and particularly to a wallet for accommodating identification and credit cards in a rugged exterior casing.

Conventional wallets are generally capable of holding credit and identification cards in sleeves within the wallet. Conventional wallets also generally have one or more pockets for storing cash, paper receipts and other folded sheets of paper. Such conventional wallets can become unwieldy when the number of credit and identification cards, as well as the amount of folded paper, exceeds the capacity limits of the wallet.

In an effort to simplify and avoid the unwieldiness of conventional wallets, some consumers opt for simple card wallets. Such card wallets store a limited number of credit and identification cards and are, in length and width, the approximate size of the cards intended to be stored, thereby reducing the size of the card wallet in comparison to a conventional wallet. A typical card wallet with a fixed thickness can only hold a limited number of credit and identification cards. What is needed is customizable card wallet that can hold a range of cards. In some embodiments, the customizable card wallet can have the ability to interchange parts such that the capacity and appearance of the wallet can be readily modified.

SUMMARY OF THE INVENTION

In some embodiments, a customizable card wallet accommodates a plurality of credit and identification cards. In some embodiments, the wallet comprises:

(a) a substantially rectangular top plate having a window opening in the central portion thereof;

(b) a substantially rectangular bottom plate having a pair of oppositely disposed relief channels at the periphery thereof for receiving a pair of oppositely disposed internal springs;

(c) a substantially U-shaped card body interposed between the top and bottom plates, thereby defining an interior pocket.

In some embodiments, upon insertion of at least one credit or identification card within the interior pocket, the internal springs urge the at least one card against the top plate interior facing surface. In at least some of these embodiments, this allows the card closest to the top plate to be seen through the window opening.

In some embodiments, the top plate is affixed to the card body by a plurality of removeable top fasteners and the bottom plate is affixed to the card body by a plurality of removeable bottom fasteners. In at least some embodiments, when thus assembled, each of the internal springs is secured between the card body and the bottom plate.

In some embodiments, each of the internal springs comprises an attachment tab fitted to the bottom plate peripheral relief channel.

In some embodiments, the internal springs are cut directly out of the bottom plate.

In some embodiments, compression springs can be used.

In some embodiments, each of the internal springs is flat. In some embodiments, the peripheral relief channels can be configured such that the internal springs are depressed flat and flush with the interior facing surface of the bottom plate when they are compressed. In at least some embodiments, this allows for the wallet to be thinner and/or accommodate more cards. In some embodiments, the internal springs can be formed from, among other things, sheet metal or plastic.

In some embodiments, the bottom plate has a slot for accommodating an accessory extending into the slot and between the card body and bottom plate. In some embodiments, the accessory can be, among other things, a money clip, a belt clip, a pocket clip, a combination money-and-pocket clip and/or a lanyard. In some embodiments, the bottom plate can have multiple slots for accommodating multiple accessories. In some preferred embodiments, the accessory has an attachment tab that extends into the accessory slot and between the card body and the bottom plate. In at least some embodiments, the bottom plate can have a recess formed therein for accommodating the accessory attachment tab.

In some embodiments, the card body is interchangeable with another card body having a different thickness, thereby accommodating a different number of credit or identification cards in the interior pocket. In some embodiments, the card body is also interchangeable with another card body having a different color or transparency.

In some embodiments, a customizable card wallet system capable of accommodating a plurality of credit and identification cards includes a substantially rectangular top plate having a window opening in the central portion thereof; a substantially rectangular bottom plate having a pair of oppositely disposed relief channels at the periphery thereof for receiving a pair of oppositely disposed internal springs; a first card body with a first width configured to be interposed between the top and bottom plates, thereby defining a first interior pocket; and a second card body with a second width configured to be interposed between the top and bottom plates, thereby defining a second interior pocket; whereby the width of a customizable card wallet can be customized by utilizing the first card body or the second card body; whereby, upon insertion of at least one credit or identification card within the first interior pocket or the second interior pocket, the internal springs urge the at least one card against the top plate interior facing surface.

DETAILED DESCRIPTION OF ILLUSTRATIVE EMBODIMENT(S)

Figure 1B:
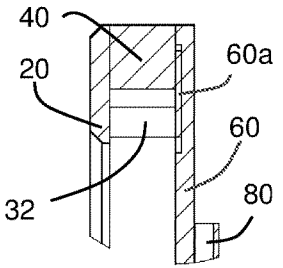
FIG. 1B is an enlarged side sectional view of the portion of the customizable card wallet encompassed by circled arrow B in FIG. 1A.
Figure 1F:
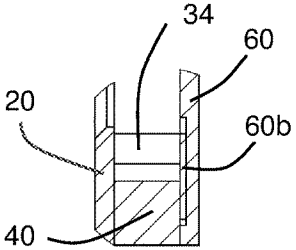
FIG. 1F is an enlarged side sectional view of the portion of the customizable card wallet encompassed by circled arrow F in FIG. 1A.
Figure 1E:
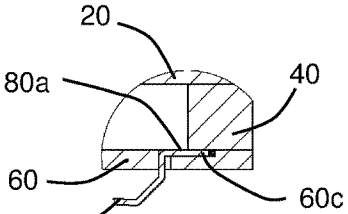
FIG. 1E is an enlarged side sectional view of the portion of the customizable card wallet encompassed by circled arrow E in FIG. 1D.
Figure 1A:
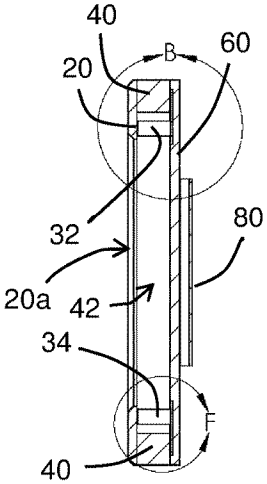
FIG. 1A is a side sectional view of the customizable card wallet taken in the direction of arrows A-A in FIG. 1.
Figure 1:
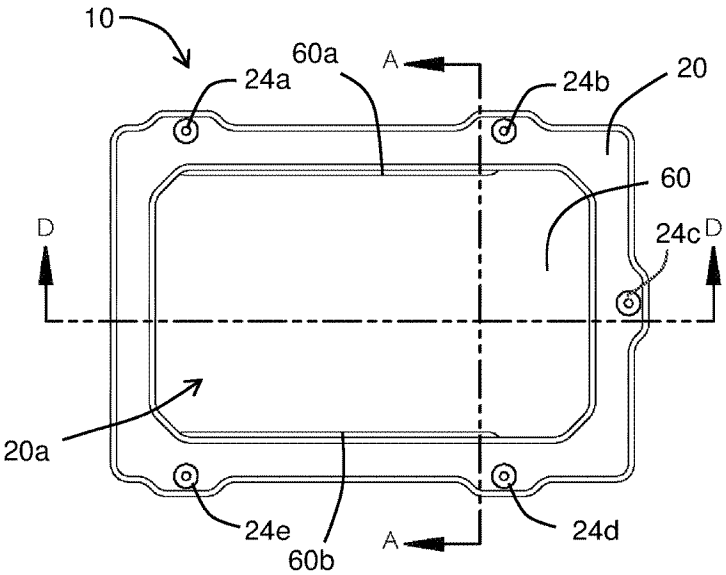
FIG. 1 is a top view of a customizable card wallet for accommodating credit and identification cards.

Turning first to FIG. 1, customizable card wallet 10 can accommodate credit and identification cards in its interior pocket. In some embodiments, card wallet 10 includes a substantially rectangular top plate 20 having window opening 20*a* formed in the central portion thereof. In some embodiments, a plurality of fasteners, shown in FIG. 1 as screws 24*a*-24*e*, affix top plate 20 to a card body disposed immediately below top plate 20. As further shown in FIG. 1, in some embodiments, bottom plate 60 has a pair of oppositely disposed relief channels 60*a* and 60*b* formed at the periphery. In some embodiments, relief channels 60*a* and 60*b* accommodate internal springs that urge credit and identification cards inserted into the interior pocket of card wallet 10 against the interior facing surface of top plate 20.

FIG. 1A is a side sectional view of card wallet 10 taken in the direction of arrows A-A in FIG. 1. As shown in FIG. 1A, card wallet 10 includes top plate 20 having window opening 20*a* formed in its central portion. In some embodiments, window opening 20*a* provides the ability to readily display an identification card, such as a driver's license, and slidably remove the identification card from the top as necessary or desirable. In some embodiments, window opening 20*a* could also be referred to as an ID view port.

As further shown in FIG. 1A, bottom plate 60 can have a pair of oppositely disposed relief channels 60*a* and 60*b* formed at the periphery of bottom plate 60 (see enlarged sectional views depicted in FIGS. 1B and 1F, respectively). In some embodiments, relief channels 60*a* and 60*b* are configured to receive a pair of oppositely disposed internal springs 32 and 34, respectively. In some embodiments, a substantially U-shaped card body 40 is interposed between top plate 20 and bottom plate 60, thereby defining interior pocket 42 for accommodating one or more credit and identification cards inserted into interior pocket 42. In some embodiments, money clip 80 is mounted on the exterior facing surface of bottom plate 60.

Figure 1D:
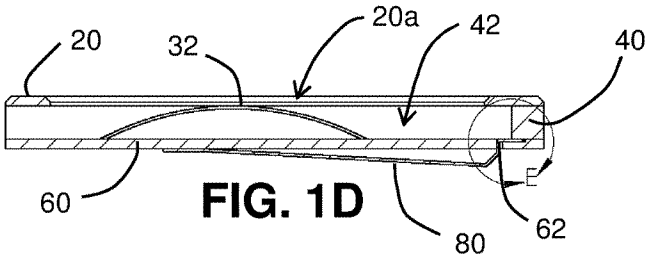
FIG. 1D is a side sectional view of the customizable card wallet taken in the direction of arrows D-D in FIG. 1.

Turning now to FIG. 1D, a side sectional view of card wallet 10, taken in the direction of arrows D-D in FIG. 1, shows card body 40 interposed between top plate 20 and bottom plate 60 so as to define interior pocket 42. In some embodiments, window opening 20*a* is formed in the central portion of top plate 20. In some embodiments, internal spring 32 extends from a relief channel formed in bottom plate 60. As shown in FIG. 1D and more specifically in the enlarged sectional view of FIG. 1F, bottom plate 60 has slot 62 formed therein. In some embodiments, money clip 80 has attachment tab 80*a* that can extend into slot 62 and between card body 40 and bottom plate 60. In some embodiments, bottom plate 60 has relief channel 60*c* for receiving money clip attachment tab 80*a*.

Figure 2:
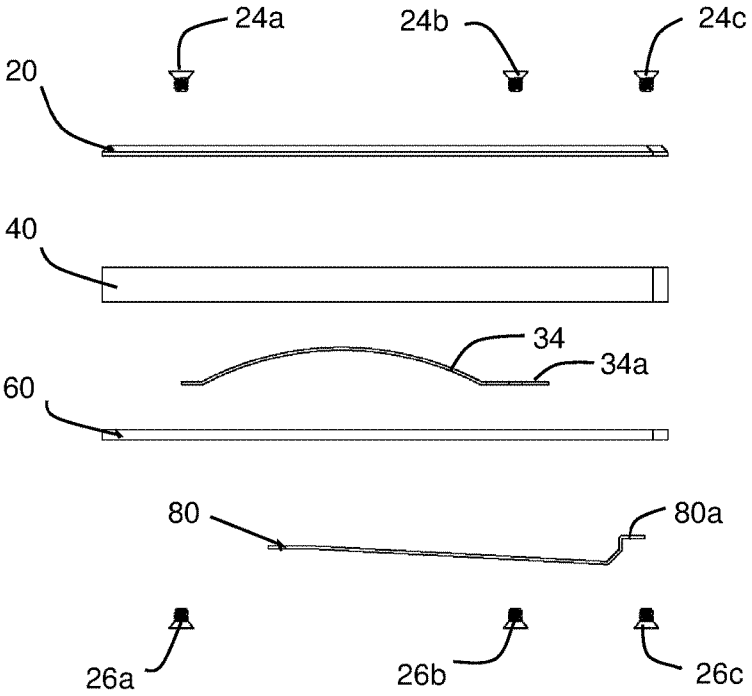
FIG. 2 is an exploded side view of the customizable card wallet depicted in assembled form in FIG. 1D.

FIG. 2 is an exploded side view of the card wallet depicted in assembled form in FIG. 1D. Card body 40 is interposed between top plate 20 and bottom plate 60. In some embodiments, spring 34 has an attachment tab 34*a* that is received within a relief channel formed in the interior facing surface of bottom plate 60. In some embodiments, a plurality of removable top fasteners, shown in FIG. 2 as screws 24*a*-24*c*, secures top plate 20 to card body 40. Similarly, in some embodiments, a plurality of screws, shown in FIG. 2 as bottom screws 26*a*-26*c*, secures bottom plate 60 to card body 40. In some embodiments, money clip 80 is mounted on the exterior facing surface of bottom plate 60 via attachment tab 80*a*.

In some of the illustrated embodiments, the card wallet is depicted with a money clip mounted to the exterior surface of the bottom plate, other accessories could be employed in place of a money clip. For example, the money clip could be replaced by a belt clip, pocket clip, combination money-and-pocket and/or a lanyard.

FIG. 2 also shows the customizable aspect of a card wallet. Specifically, with the screws removed, card body 40 is interchangeable with another card body having a different thickness, thereby accommodating a different number of credit or identification cards in the interior pocket of the card wallet.

In some embodiments, the card wallet is configured to hold between 1 and 3 cards. In some embodiments, the card wallet is configured to hold between 1 and 4 cards. In some embodiments, the card wallet is configured to hold between 1 and 5 cards. In some embodiments, the card wallet is configured to hold between 1 and 6 cards. In some embodiments, the card wallet is configured to hold between 1 and 7 cards. In some embodiments, the card wallet is configured to hold between 1 and 8 cards.

In some embodiments, card body 40 is interchangeable with another card body having a different color or transparency.

Figure 3:
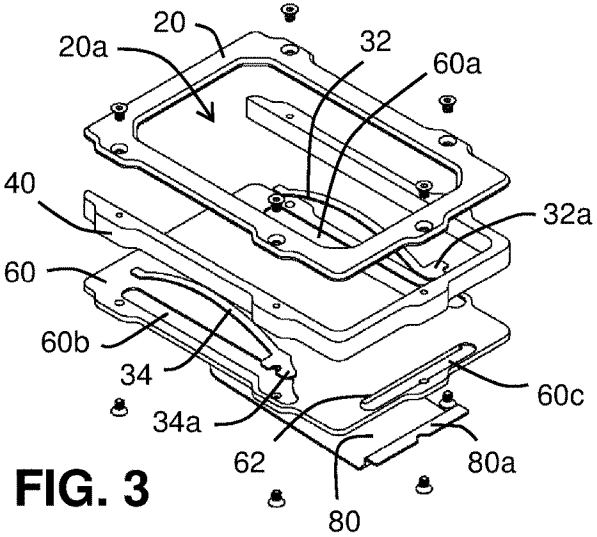
FIG. 3 is an exploded perspective view of the top side of the customizable card wallet.
Figure 4:
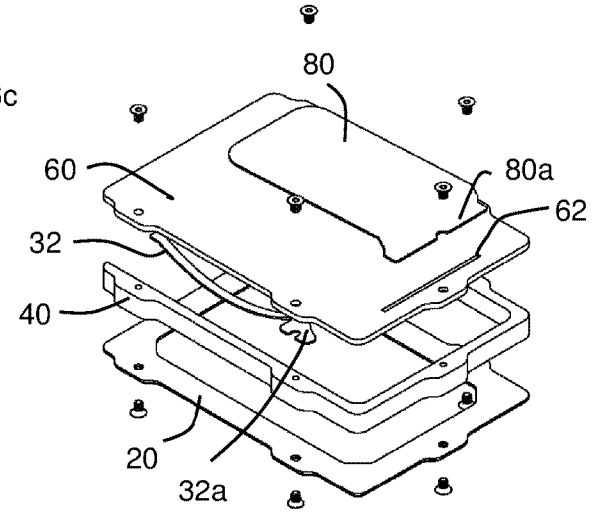
FIG. 4 is an exploded perspective view of the bottom side of a customizable card wallet.

FIGS. 3 and 4 show exploded perspective views of the top side and bottom side, respectively, of a card wallet. In addition to the relative positioning of top plate 20, card body 40 and bottom plate 60, FIG. 3 shows the configuration of relief channels 60*a*, 60*b* and 60*c*. As shown, relief channel

60*b* accommodates internal spring 34 and provides a nesting configuration for spring 34 such that spring attachment tab 34*a* does not protrude above the interior facing surface of bottom plate 60. Relief channel 60*a* performs the same function for internal spring 32. In some embodiments, relief channel 60*c* accommodates attachment tab 80*a* of money clip 80 (or other accessory) and provides a similar nesting configuration such that money clip attachment tab 80*a* does not protrude above the interior facing surface of bottom plate 60.

Figure 5B:
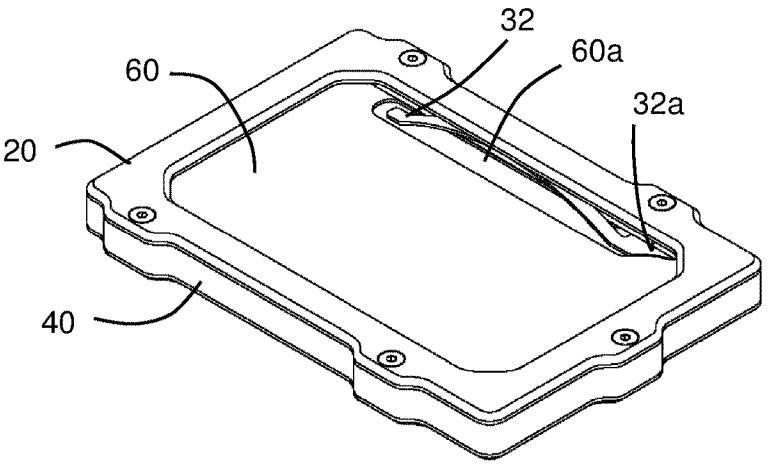
FIG. 5B is a top perspective view of a customizable card wallet.
Figure 5D:
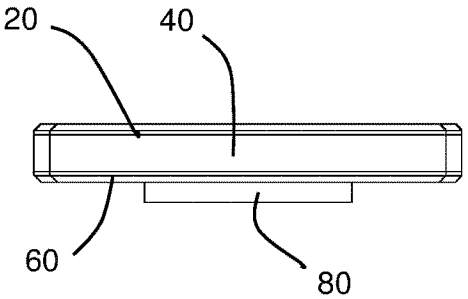
FIG. 5D is a back view of a customizable card wallet
Figure 5A:
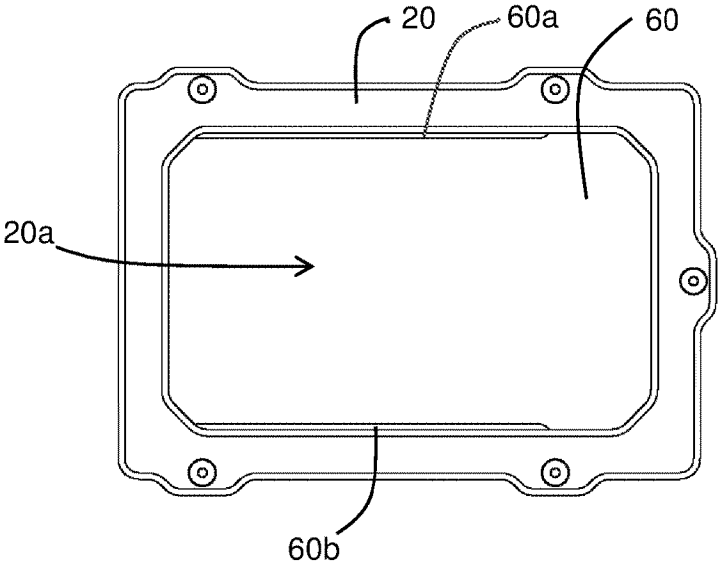
FIG. 5A is a top view of a customizable card wallet.
Figure 5C:
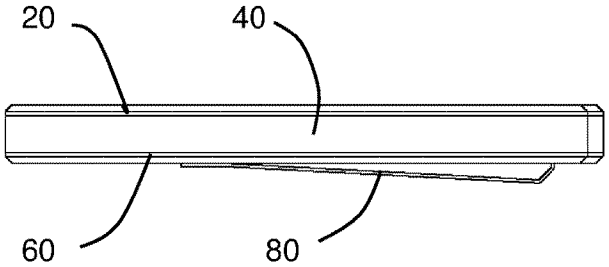
FIG. 5C is a side view of a customizable card wallet.
Figure 6B:
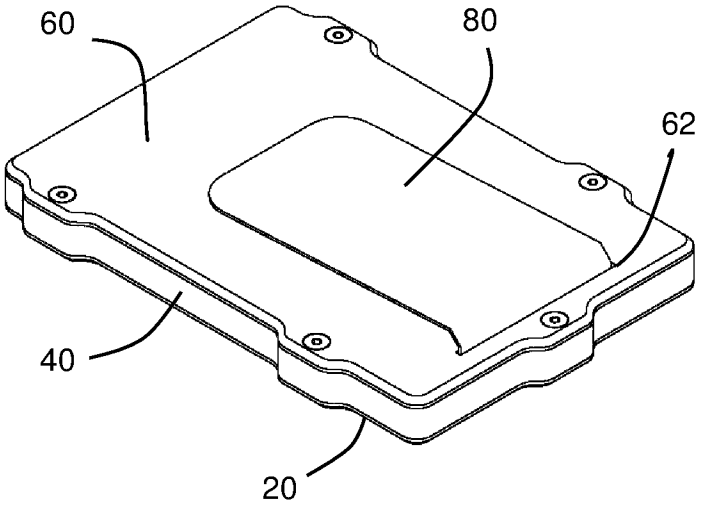
FIG. 6B is a bottom perspective view of a customizable card wallet.
Figure 6D:
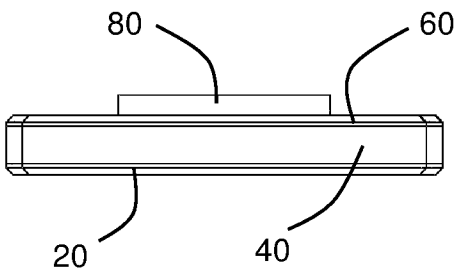
FIG. 6D is a back view of a customizable card wallet
Figure 6A:
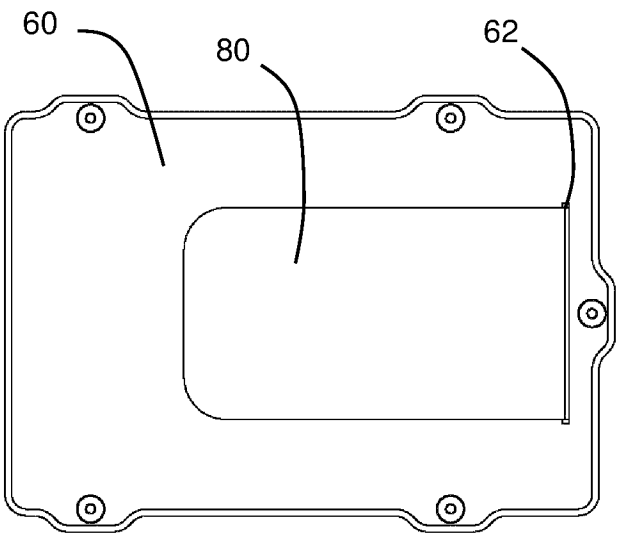
FIG. 6A is a bottom view of a customizable card wallet.
Figure 6C:
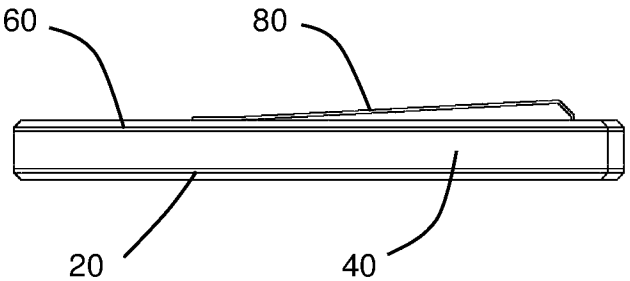
FIG. 6C is a side view of a customizable card wallet.

FIGS. 5A-5D are top, perspective, side and back views, respectively, of the top side of a card wallet. FIG. 5B shows in particular the nesting configuration of spring 32 within relief channel 60 a formed in the interior facing surface of bottom plate 60. FIGS. 6A-6D are top, perspective, side and back views, respectively, of the bottom side of a card wallet.

FIGS. 7A-7D are top, perspective, side and back views, respectively, of the bottom side of card wallet 110 with money clip 180 with cutout 190. In some embodiments, cutout 190 allows greater flexibility in money clip 180 when compared to versions without cutout 190. Cutout 190 also allows a user the ability to see part of the item held behind money clip 190. In at least some embodiments, card body 140 is interposed between top plate 120 and bottom plate 160. In at least some embodiments, bottom plate 160 has a slot 162 formed therein. In some embodiments, money clip 180 has an attachment tab that can extend into slot 162 and between card body 140 and bottom plate 160.

Figure 7B:
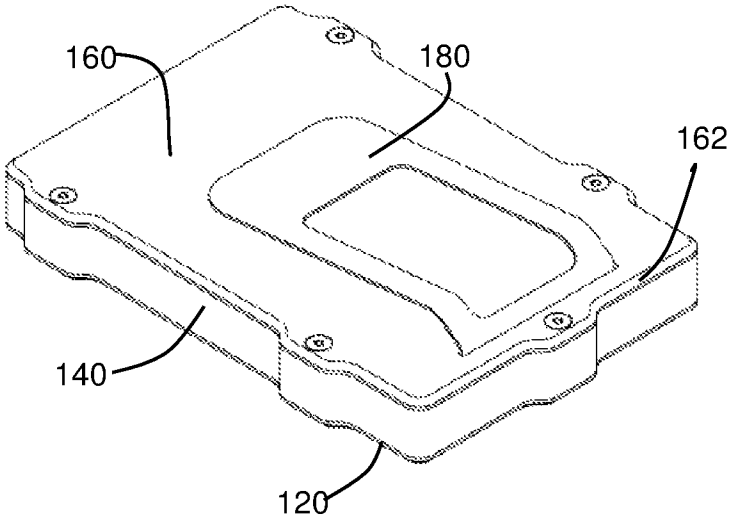
FIG. 7B is a bottom perspective view of a customizable card wallet.
Figure 7D:
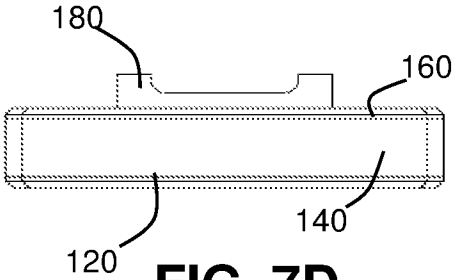
FIG. 7D is a back view of a customizable card wallet
Figure 7A:
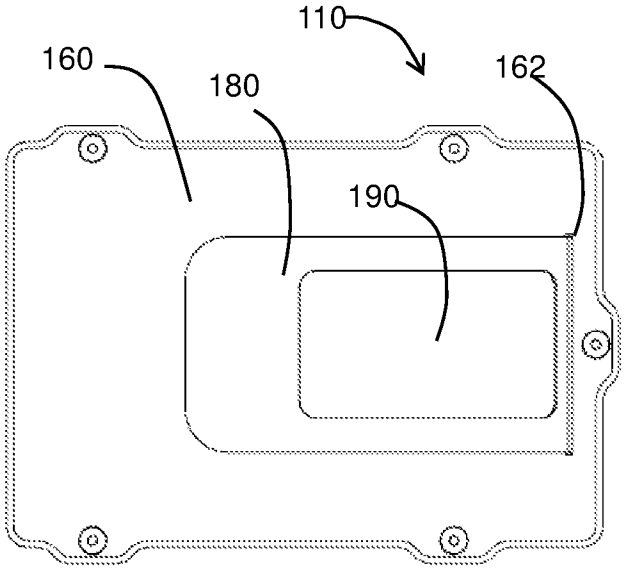
FIG. 7A is a bottom view of a customizable card wallet.
Figure 7C:
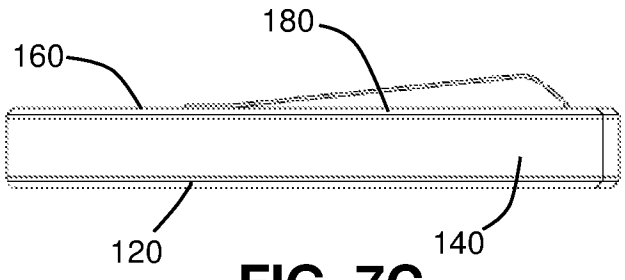
FIG. 7C is a side view of a customizable card wallet.
Figure 7F:
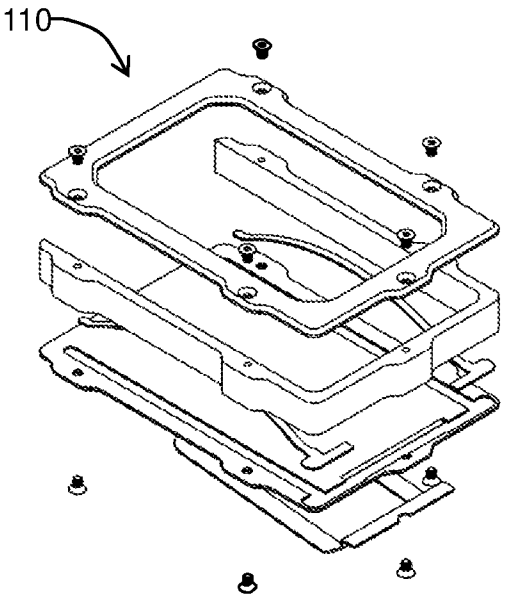
FIG. 7F is an exploded perspective view of the top side of a customizable card wallet.
Figure 7E:
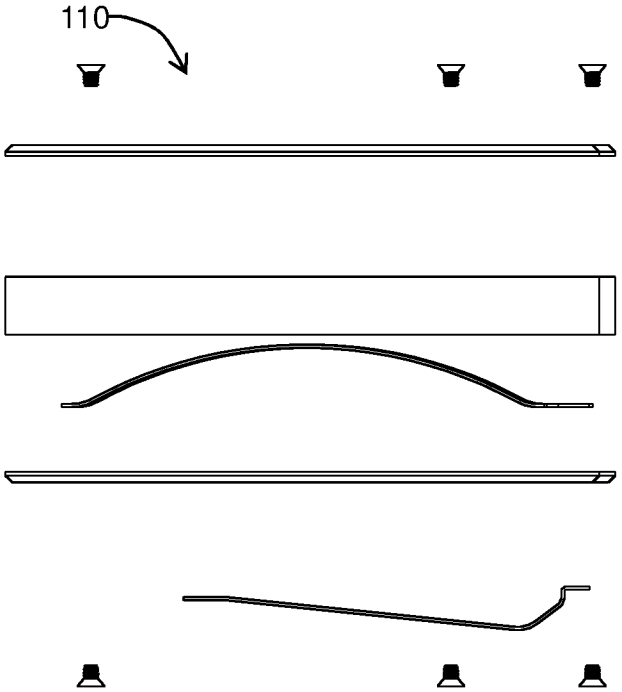
FIG. 7E is an exploded side view of the customizable card wallet depicted in assembled form in FIG. 7B.
Figure 7G:
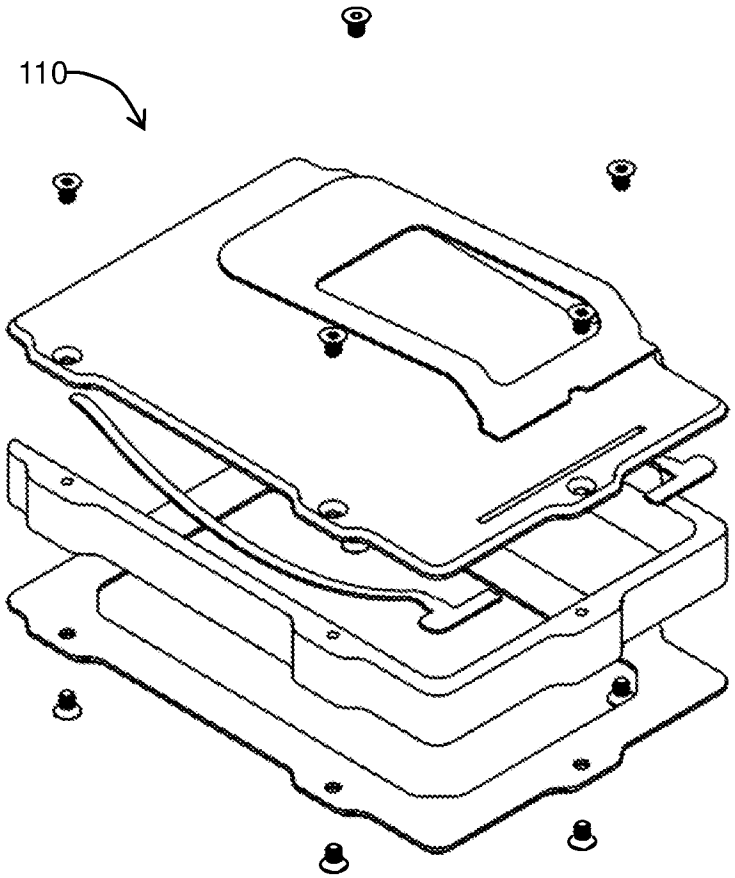
FIG. 7G is an exploded perspective view of the bottom side of a customizable card wallet.

FIG. 7E are exploded side view of customizable card wallet 110. FIG. 7F is an exploded perspective view of the top side of customizable card wallet 110. FIG. 7G is an exploded perspective view of the bottom side of customizable card wallet 110.

FIGS. 8A-8D are top, perspective, side and back views, respectively, of the bottom side of card wallet 210 with combination money-and-pocket clip 280. Combination money-and-pocket clip 280 acts as both a traditional money clip, while also allowing a user to securely attach card wallet 210 to their pocket. This is especially advantageous for users who want to carry card wallet 210 in their front pocket. In some embodiments, cutout 290 allows greater flexibility in combination money-and-pocket clip 280 when compared to versions without cutout 290. Cutout 290 also allows a user the ability to see part of the item held behind with combination money-and-pocket clip 280.

In at least some embodiments, card body 240 is interposed between top plate 220 and bottom plate 260. In at least some embodiments, bottom plate 260 has a slot 262 formed therein. In some embodiments, combination money-and-pocket clip 280 has an attachment tab that can extend into slot 262 and between card body 240 and bottom plate 260.

Figure 8A:
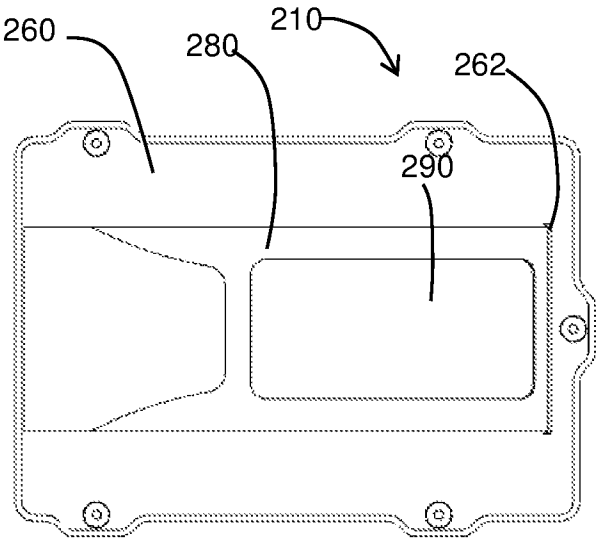
FIG. 8A is a bottom view of a customizable card wallet.
Figure 8B:
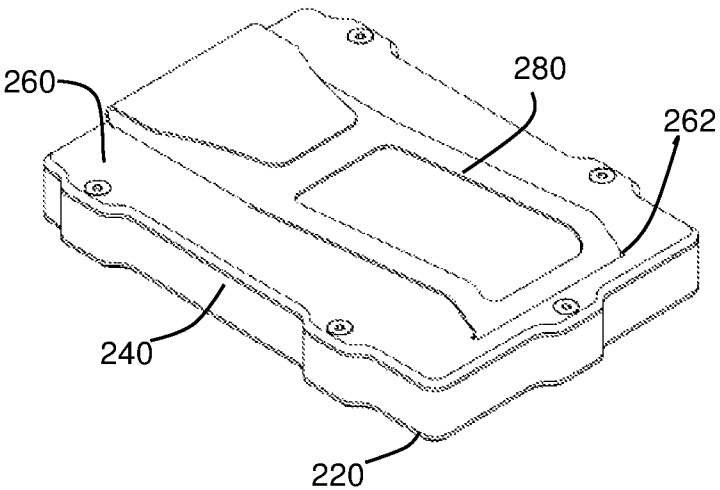
FIG. 8B is a bottom perspective view of a customizable card wallet.
Figure 8C:
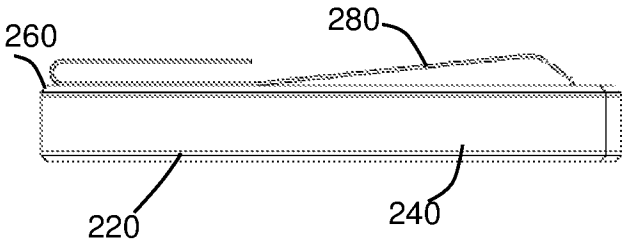
FIG. 8C is a side view of a customizable card wallet.
Figure 8D:
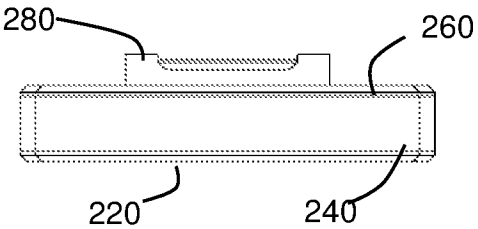
FIG. 8D is a back view of a customizable card wallet
Figure 8F:
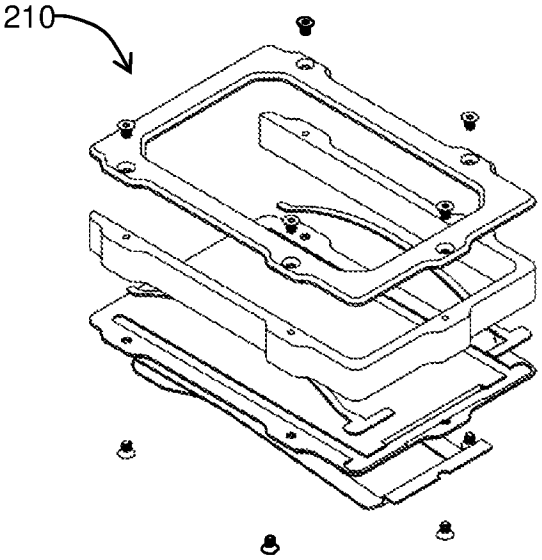
FIG. 8F is an exploded perspective view of the top side of a customizable card wallet.
Figure 8E:
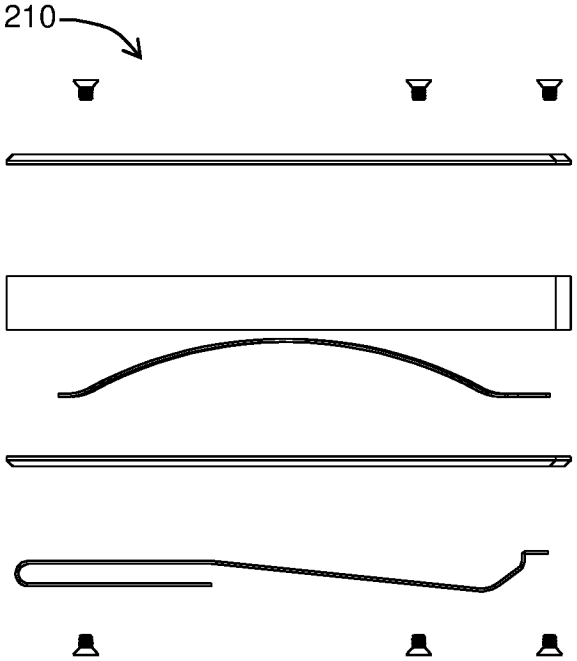
FIG. 8E is an exploded side view of the customizable card wallet depicted in assembled form in FIG. 8B.
Figure 8G:
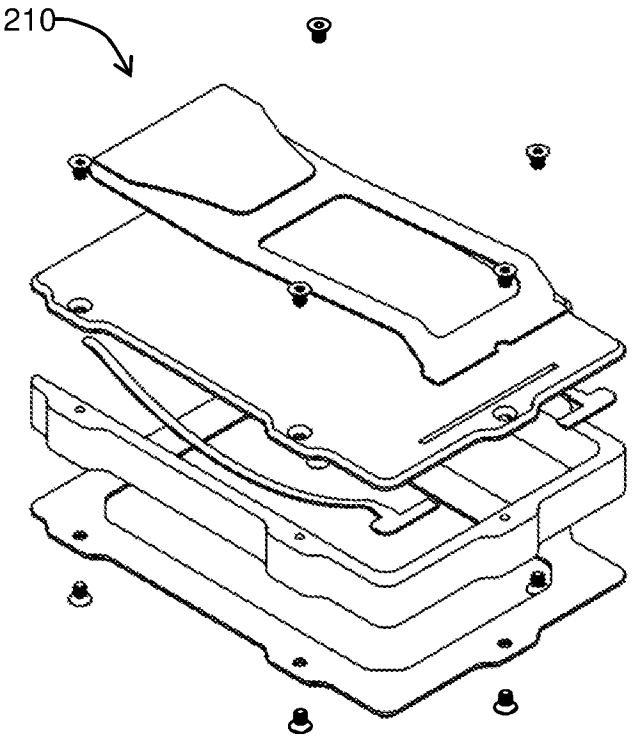
FIG. 8G is an exploded perspective view of the bottom side of a customizable card wallet.

FIG. 8E are exploded side view of customizable card wallet 210. FIG. 8F is an exploded perspective view of the top side of customizable card wallet 210. FIG. 8G is an exploded perspective view of the bottom side of customizable card wallet 210.

In at least some embodiments, the customizable card wallet employs RFID-blocking technology. Card wallets employing this technology can prevent, or at least reduce, the chance of data beings stolen from an RFID-enabled credit card or ID.

In some embodiments, customizable card wallet is made, at least in part, of aluminum. In some embodiments, customizable card wallet is made, at least in part, of carbon fiber.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A customizable card wallet capable of accommodating a plurality of credit and identification cards, the customizable card wallet comprising:

(a) a substantially rectangular top plate having a window opening in a central portion thereof;

(b) a substantially rectangular bottom plate having a pair of oppositely disposed relief channels at the periphery thereof for receiving a pair of oppositely disposed internal springs; and (c) a substantially U-shaped card body interposed between said top plate and said bottom plate, thereby defining an interior pocket;

whereby, upon insertion of an at least one credit or identification card within said interior pocket, said internal springs urge said at least one credit or identification card against said top plate interior facing surface; and wherein each of said internal springs comprises an attachment tab fitted to said pair of oppositely disposed relief channels.

2. The customizable card wallet of claim 1, wherein said top plate is affixed to said substantially U-shaped card body by a plurality of removeable top fasteners and said bottom plate is affixed to said substantially U-shaped card body by a plurality of removeable bottom fasteners.

3. The customizable card wallet of claim 2, wherein each of said internal springs is secured between said substantially U-shaped card body and said bottom plate.

4. The customizable card wallet of claim 1, wherein each of said internal springs is flat.

5. The customizable card wallet of claim 4, wherein said pair of oppositely disposed relief channels are configured such that said internal springs are capable of being depressed flat and flush with the interior facing surface of said bottom plate.

6. The customizable card wallet of claim 1, wherein said bottom plate has a slot for accommodating an accessory extending into said slot and between said substantially U-shaped card body and said bottom plate.

7. The customizable card wallet of claim 6, wherein said accessory is a money clip, a belt clip, a pocket clip or a lanyard.

8. The customizable card wallet of claim 6, wherein said accessory has an attachment tab extending therefrom, said attachment tab capable of extending into said slot and between said substantially U-shaped card body and said bottom plate.

9. The customizable card wallet of claim 8, wherein said bottom plate has a recess formed therein for accommodating said attachment tab.

10. The customizable card wallet of claim 1, wherein each of said internal springs is formed from sheet metal or plastic.

11. The customizable card wallet of claim 1, wherein said substantially U-shaped card body is interchangeable with another card body having a different thickness, thereby accommodating a different number of credit or identification cards in said interior pocket.

12. The customizable card wallet of claim 1, wherein said substantially U-shaped card body is interchangeable with another card body having a different color or transparency.

13. The customizable card wallet of claim 6, wherein said accessory is a money clip.

14. The customizable card wallet of claim 6, wherein said accessory is a combination money-and-pocket clip.

* * * * *